US006793075B1

(12) United States Patent
Jeter

(10) Patent No.: US 6,793,075 B1
(45) Date of Patent: Sep. 21, 2004

(54) CONTAINER FOR DISPENSING A LIQUID AND METHOD OF USING THE SAME

(76) Inventor: Michael Jeter, 1150 Estate Dr., Suite C, Abilene, TX (US) 79602

( * ) Notice: Subject to any disclaimer, the term of this patent is extended or adjusted under 35 U.S.C. 154(b) by 247 days.

(21) Appl. No.: 10/159,137

(22) Filed: May 30, 2002

(51) Int. Cl.[7] ..... B65D 85/00; A47G 19/22

(52) U.S. Cl. ..... 206/459.1; 40/310; 215/11.4; 215/230; 215/365; 220/710.5; 220/714

(58) Field of Search ..... 206/459.1, 459.5; 40/310; 215/11.4–11.6, 230, 365; 220/710.5, 711, 714, 745, 759; 222/562

(56) References Cited

U.S. PATENT DOCUMENTS

| | | | | | |
|---|---|---|---|---|---|
| 560,916 | A | | 5/1896 | McDonough et al. | |
| 2,031,892 | A | | 2/1936 | Johnson | |
| 3,100,487 | A | * | 8/1963 | Bathish | 206/459.1 |
| 3,365,099 | A | * | 1/1968 | McTaggart | 206/459.1 |
| 3,599,362 | A | | 8/1971 | Klober | |
| 3,885,562 | A | | 5/1975 | Lampkin | |
| 4,207,982 | A | * | 6/1980 | Maxwell et al. | 206/459.1 |
| 5,046,605 | A | * | 9/1991 | Levrant | 206/459.1 |
| 5,046,609 | A | * | 9/1991 | Mangini et al. | 206/459.5 |
| 5,118,014 | A | | 6/1992 | Hestehave et al. | |
| 5,400,907 | A | * | 3/1995 | Chen | 206/459.1 |
| 5,607,078 | A | | 3/1997 | Nordberg et al. | |
| 5,699,937 | A | | 12/1997 | Canela | |
| 5,979,698 | A | * | 11/1999 | Deal | 206/459.5 |
| 6,102,245 | A | * | 8/2000 | Haberman | 220/714 |
| RE37,016 | E | | 1/2001 | Morano | |

* cited by examiner

*Primary Examiner*—Luan K. Bui
(74) *Attorney, Agent, or Firm*—Jackson Walker LLP

(57) ABSTRACT

A drinking cup having a spill proof lid and a container. The lid fits to the container. The container has a place to write information, such as a medication dosage. The container also scaled gradations to determine the volume of fluid in the container.

14 Claims, 2 Drawing Sheets

CONTAINER FOR DISPENSING A LIQUID AND METHOD OF USING THE SAME

FIELD OF THE INVENTION

Drinking containers, more specifically a drinking container including a spill proof lid and a writing surface on the side walls thereof, the writing surface adjacent a scale containing gradations for indicating the volume of the liquid contained therein, and a method for using the novel drinking container for recording dosages of a liquid therefrom.

BACKGROUND OF THE INVENTION

Various devices in the prior art have been provided for administering metered dosages of a liquid to a patient. For example, U.S. Pat. No. 5,699,937 discloses a container including a dosage dispenser incorporated on the inner walls thereof and scale markings on the outside of the dispenser so a user can ascertain the volume of liquid inside the container and inside the dispenser. U.S. Pat. No. 5,607,078 discloses a graduated drinking mug having a handle with a moveable slider for keeping track of a volume of fluid in the container, the slider adjacent scaled markings in the handle. U.S. Pat. No. 2,031,892 discloses a drinking vessel having scaled gradations marked on the side thereof and a lid, the lid including clips, the clips to hold a card onto the lid, the card for indicating the patient's dosage prescription.

None of the prior art, however, provides the convenience of Applicant's novel combination of features, including scaled gradations or markings vertically oriented on the side walls of the container to determine the amount of liquid therein and a vertically oriented window adjacent the gradations and a writing surface for marking an initial level and subsequent levels of fluid in the container and thereby ascertain the amount of fluid consumed by a patient over a lime period. Other features of Applicant's novel drinking vessel include a spill proof lid, a hand conforming handle, insulation and a removable base.

DETAILED DESCRIPTION OF THE PREFERRED EMBODIMENT

Figure 1:
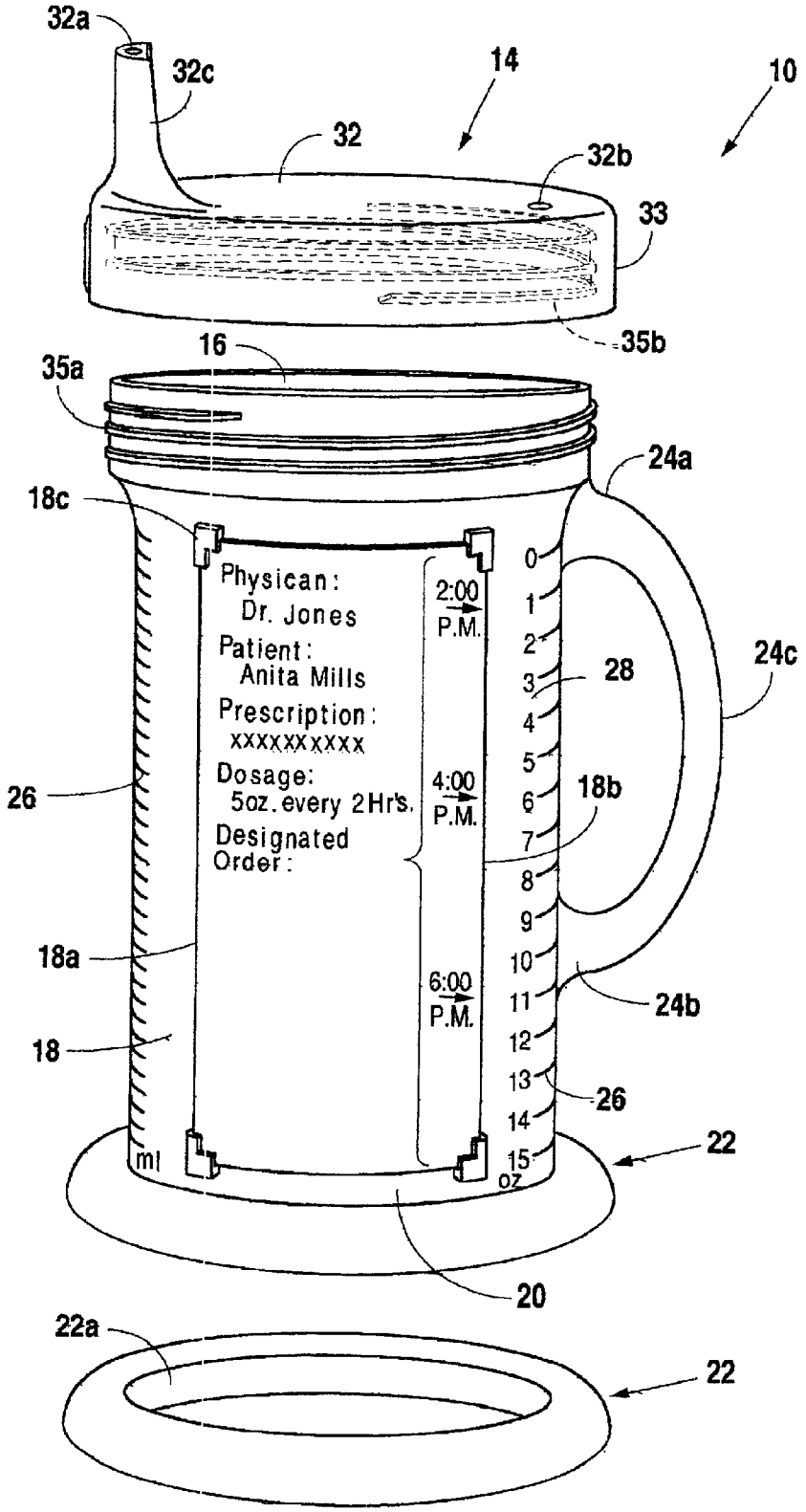
Figure 2:
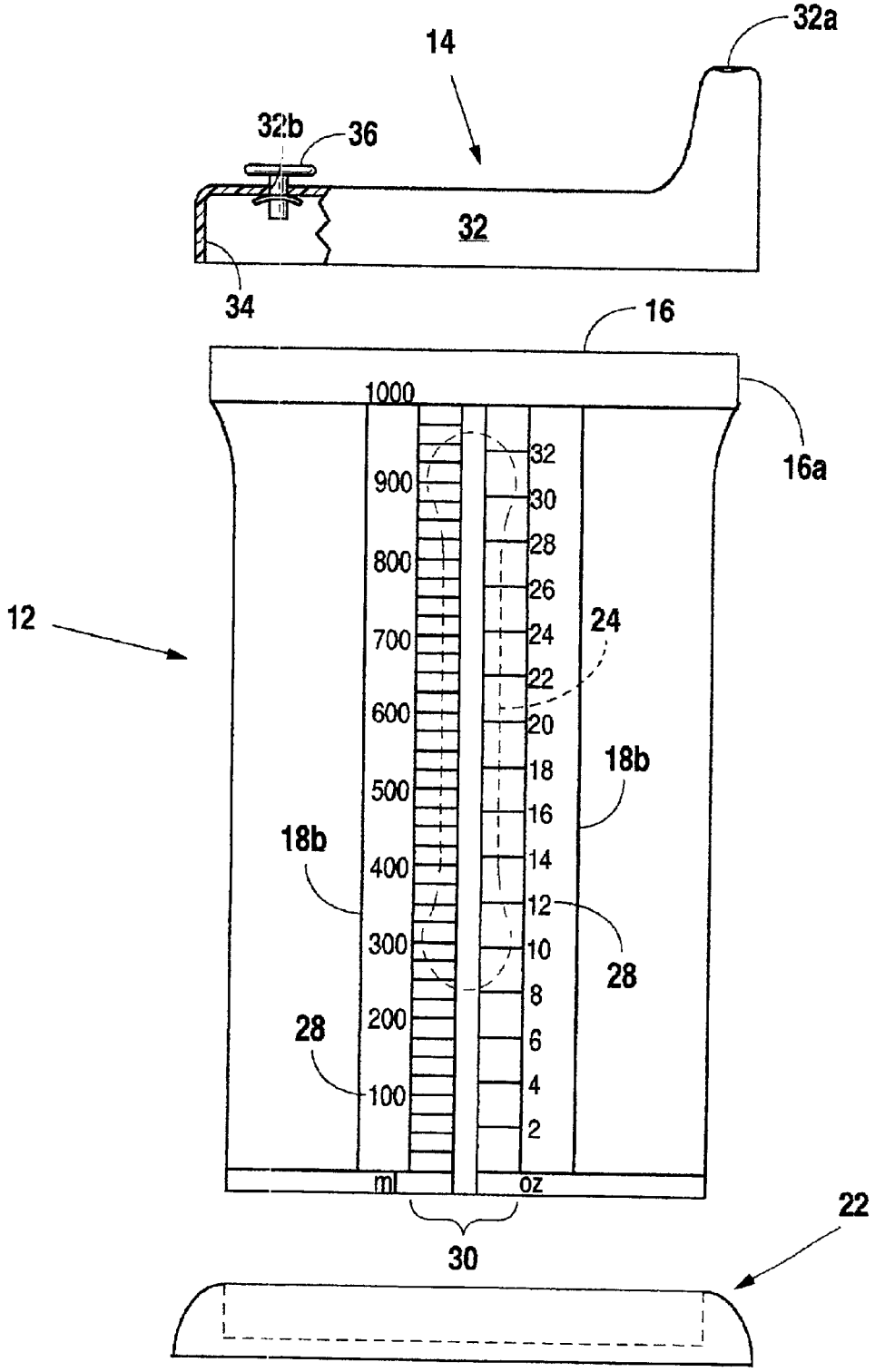

FIGS. 1 and 2 illustrate preferred embodiments of Applicant's present invention.

FIG. 1 illustrates Applicant's novel drinking container 10, the drinking container including a body portion 12 and lid portion 14, the lid for removable attachment to the body portion, the lid preferably being a "spill proof" lid as known in the prior art as hereinafter described. One such lid is disclosed in U.S. Pat. Reg. No. 37,016 Reissued Jan. 16, 2001, the specification and drawings which are incorporated herein by reference. The Reissue Patent discloses a spill proof lid with a flow control element. The flow control element is normally closed, only the users vacuum creation (as by sucking at a drinking orifice) will allow a liquid to flow. The body portion and/or the lid portion may be made from hard plastic, glass or other durable, suitable material. The body portion is seen to include side walls 18, here the side walls being vertical and cylindrical in nature, the sidewalls including a writing panel 18A on the surface thereof, the writing panel having a vertical border 18B and, in an alternate preferred embodiment slots 18C for receipt of a removable membrane 19 capable of receiving writing thereon. It is seen in the embodiment illustrated in FIG. 1 that writing panel 18A is a membrane, such as an appropriate dimensioned paper card, in a rectangular shape and intended for engagement with body portion 12 through the use of vertical slots or channels 18C.

In an alternate preferred embodiment in FIG. 2 writing panel 18A is integral with the side walls and is typically a roughened or frosted area so as to be capable of accepting writing on the surface thereof. In either case, side walls include a writing panel 18A which may include a membrane 19 or may be integral with the side walls, for the receipt of writing thereon, the writing panel including a vertical border 18B. Note that the vertical border is adjacent a scale 28, such as a scale for denoting the volume of a liquid in the container-for example, a scale marked in either oz. (ounces) or milliliters (ml.). Adjacent the scale are gradations marks 26 and both the scale and gradations marks are adjacent vertical border 18B.

Returning to body portion 12, it is seen to include, optionally, a flared base 22 the flared base having a diameter greater than the greatest distance between the side walls, for providing stability when the container is resting on a support surface. The base may be formed integral with the side walls or may, as in FIG. 1 include interior walls 22A dimensioned for receipt of closed bottom 20 snuggly thereinto, to maintain the base engaged with the side walls through a friction or interference fit.

Applicant's novel drinking container may also include a handle 24, typically joined to the side walls and capable of being grasped by a patient, the handle maybe in any of a variety of configurations but may include removed ends 24A and 24B with a body 24C therebetween The removed ends may be attached to the side walls so as to align the handle in vertical orientation. The handle may be dimensioned to include a body portion that is scalloped, oval or square, or otherwise shaped to fit the particular needs of the environment. There may be one handle or multiplicity of handles.

In FIG. 2 Applicant's are seen to provide side walls 18 that may be partially opaque but include one or more vertically oriented, narrow, clear windows 30, the clear windows having horizontal gradation marks 26, the gradation marks keyed to a scale 28 to designate a level of fluid in the container. It is seen, for example, in FIG. 2 that there are a pair of clear windows 30, one of which is designated in a milliliter scale and the other designated in ounces. Note again that the vertical border 18B is adjacent, indeed may make contact with, the individual gradation marks on the side walls.

Turning now to Applicant's lid portion 14 it is seen in FIGS. 1 and 2 that the lid portions are slightly different. Both figures, however, disclose lids that are "spill proof." In FIG. 1 it is seen that lid portion 14 includes a top surface 32 and side walls 33. It is noted that side walls 33 in FIG. 1 may include threaded outer walls 355B for engagement with matching threaded outer walls 35A adjacent open top 16 for threadable engagement between the lid and the open top. A gasket (not shown) may be used to help seal the lid to the open top. Again with reference to the lid illustrated in FIG. 1 it is seen that the lid includes a top surface 32 which has a drinking orifice 32A incorporated thereinto. Opposite the drinking orifice 32A is a vent orifice 32B for venting the interior of the container so as to facilitate drinking therefrom through the drinking orifice 32A. The drinking orifice may be located at the tip of a drinking snout 32C.

Turning now to FIG. 2 it is seen that an alternate preferred embodiment of Applicant's lid portion 14 it is disclosed. This lid portion, which is known in the prior art includes, inner side walls 34 for snug friction fit with smooth outer walls 16A adjacent open top 16. An advantage of the friction fit over the threaded engagement means is that with friction fit the drinking orifice may be rotated and positioned anywhere with respect to the handle, for ease of drinking. It is seen in FIG. 2 that vent orifice 32B includes a valve 36 that will prevent the passage of a fluid therethrough and will open in response to a drinking drawing suction, the suction within the container generating a pressure differential that will open a normally closed valve 36.

Turning back to FIG. 1 it is seen that Applicant's novel drinking container 10 includes a writing panel 18A with a vertical border 18B adjacent scale 28 and gradation marks 26. FIG. 1 illustrates a manner of using a writing instrument (not shown) and a writing panel to designate certain information regarding the patient, such as the patient name, the treating doctor's name, the type of dosage contained in the container, the doctor's orders regarding the dosage, etc. Note that by positioning the vertical border of the writing panel adjacent the gradation marks and scale, arrows can indicate the fluid levels in the container at certain times. For example, in FIG. 1 it is seen that there was 13 oz. of the designated liquid in the container at 2:00 P.M. on a designated date At 4:00 P.M. on designated date it was seen that there are 10 oz., such as indicated by the marking "arrows" indicated adjacent the gradation marks, any type of marking can be used to show the liquid level in the container and a time placed right next to the at mark. This, for example shows that there was 3 oz. of fluid consumed between 2:00 P.M. and 4:00 P.M. Two hours later, at 6:00 P.M. the fluid level was down to 5 oz. as indicated by the markings on the writing panel 18A ("6:00 P.M."). This is a convenient method of utilizing Applicant's novel drinking container 10 maintained an active record of the fluid intake of a patient.

It is understood that while the preferred embodiment of Applicant's present invention uses the term for "dosage" this term is broad enough to include any medicine or, in fact, any liquid. Indeed, Applicant's novel invention and method may be utilized anywhere that metering of a liquid is required. Further, while the specifications and claims show the gradation scale in milliliters and/or ounces, they can be, in fact, any volumetric unit of measurement. Note also that in a preferred embodiment, the "zero" would be at the top and the maximum volume would be at the bottom (see FIG. 2). Finally, although the cup may be any size, the typical volume would range from 0.25 liters to 1.25 liters.

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. It is, therefore, contemplated that the appended claims will over such modifications that fall within the scope of the invention.

I claim:

1. A drinking container for use as a dosage dispenser, the drinking container comprising:

a cylindrical body portion having an open top, closed bottom and side walls, the side walls including a panel capable of receiving writing thereon, the panel including a vertical border, the side walls including scaled indicia thereon, the scaled indicia adjacent the vertical border of the panel;

a handle for attachment to the side walls of the body portion;

a spill proof lid; and means for removably attaching the spill proof lid to the body portion.

2. The drinking container of claim 1 wherein the handle includes a pair of spaced apart removed ends and an elongated body portion therebetween, the removed ends attached to the side walls of the body so that the body portion is vertically aligned.

3. The drinking container of claim 1 wherein the scaled indicia is in ounces and/or milliliters.

4. The drinking container of claim 1 wherein means for removably attaching the spill proof lid includes threads on the lid and matching threads on the open top of the cylindrical body portion.

5. The drinking container of claim 1 wherein the cylindrical body is made of glass or plastic.

6. The drinking container of claim 1 wherein the cylindrical body includes a clear vertical window with the indicia including a multiplicity of horizontal lines across the window.

7. The drinking container of claim 6 further including a flared base.

8. The drinking container of claim 7 wherein the base is removable from the cylindrical body portion.

9. The drinking container of claim 1 wherein the cylindrical body is insulated.

10. The drinking container of claim 1 wherein the spill proof lid includes a top surface, the top surface having a drinking orifice and, spaced apart therefrom, a venting orifice.

11. The drinking container of claim 1 wherein the spill proof lid includes a drinking orifice and a valve adjacent the drinking orifice, the valve capable of for opening in response to suction at the drinking orifice.

12. The drinking container of claim 1 wherein the panel is found integral with the sidewalls and includes a roughened portion.

13. The drinking container of claim 1 wherein sidewalls include slots and the panel includes a removable member.

14. The drinking container of claim 1 wherein means for removably attaching the spill proof lid to the body portion includes inner walls on a lip of the lid dimensioned for snug, friction fit against outer walls of the open top of the cylindrical body portion.

* * * * *